US008580082B2

(12) United States Patent
Gane et al.

(10) Patent No.: US 8,580,082 B2
(45) Date of Patent: Nov. 12, 2013

(54) COMPOSITIONS OF CALCIUM CARBONATES/PIGMENTS FOR PAPER FORMULATIONS, SHOWING PRINT THROUGH REDUCTION

(75) Inventors: Patrick Arthur Charles Gane, Rothrist (CH); Joachim Schölkopf, Killwangen (CH); Maximilian Laufmann, Zofringen (CH); Michael Pohl, Villach (AT)

(73) Assignee: Omya International AG, Oftringen (CH)

( * ) Notice: Subject to any disclaimer, the term of this patent is extended or adjusted under 35 U.S.C. 154(b) by 0 days.

(21) Appl. No.: 12/737,928

(22) PCT Filed: Sep. 8, 2009

(86) PCT No.: PCT/IB2009/006777

§ 371 (c)(1), (2), (4) Date: Mar. 1, 2011

(87) PCT Pub. No.: WO2010/029403

PCT Pub. Date: Mar. 18, 2010

(65) Prior Publication Data

US 2011/0146931 A1 Jun. 23, 2011

(30) Foreign Application Priority Data

Sep. 9, 2008 (EP) ..... 08015881

(51) Int. Cl.
*D21H 11/00* (2006.01)

(52) U.S. Cl.
USPC ..... 162/181.2

(58) Field of Classification Search
USPC ..... 162/181.2, 158, 206, 181.8, 181.4
See application file for complete search history.

(56) References Cited

U.S. PATENT DOCUMENTS

| | | | | |
|---|---|---|---|---|
| 6,887,351 | B1 * | 5/2005 | Lunden et al. | 162/181.2 |
| 2004/0108081 | A1 | 6/2004 | Hughes | |
| 2007/0202279 | A1 | 8/2007 | Schultz et al. | |
| 2007/0218222 | A1 | 9/2007 | Campbell et al. | |

FOREIGN PATENT DOCUMENTS

| | | |
|---|---|---|
| WO | WO 99/61703 | 12/1999 |
| WO | WO 03/050355 A1 | 6/2003 |
| WO | WO 03/054300 | 7/2003 |

OTHER PUBLICATIONS

The International Search Report dated May 11, 2009 for PCT Application No. PCT/IB2009/006777.
The Written Opinion of the International Searching Authority for PCT Application No. PCT/IB2009/006777.

* cited by examiner

*Primary Examiner* — Mark Halpern
(74) *Attorney, Agent, or Firm* — Amster, Rothstein & Ebenstein LLP

(57) ABSTRACT

The present invention relates to mixtures of two distinct porous, stable aggregates and rather coarse PCCs (precipitated) calcium carbonate pigments (such as a composition comprising a blend or mix of one of the two Grade B or Grade C PCCs, in combination with a second, specific S-PCC (S=scalenohedral type PCC) pigment in a ratio appropriately selected between 90/10 and 10/90 percent by dry weight, namely 80/20 and 20/80, with a coarser, third component, which may be a pigment and/or a filler such as natural calcium (ground) carbonate or (most preferably) a PCC (precipitated calcium carbonate), depending on the granulometry of the two fine PCCs the third, coarser component, may be omitted. The main criteria for selecting the said "coarser" pigment is that it should feature a granulometry which does no affect noticeably, when in admixture with the blend PCC Grade B (or PCC Grade C) with S-PCC the finest part of the granulometry data of the blend, and in particular that it should not contribute anything significant to the amount of particles <0.2 μm, preferably nothing <0.3 μm, more preferably nothing <0.5 μm and most preferably nothing <1 μm.

22 Claims, 3 Drawing Sheets

COMPOSITIONS OF CALCIUM CARBONATES/PIGMENTS FOR PAPER FORMULATIONS, SHOWING PRINT THROUGH REDUCTION

This is a U.S. national phase of PCT Application No. PCT/IB2009/006777, filed Sep. 8, 2009, which claims priority to European Application No. 08015881.9, filed Sep. 9, 2008.

The present invention relates to mixtures of two distinct porous, stable aggregates and rather coarse PCCs (precipitated) calcium carbonate pigments with a coarser, third component, which may be a pigment or a filler such as natural calcium (ground) carbonate or (most preferably) a PCC (precipitated calcium carbonate), or optionally but far less preferred talc, kaolin, titanium oxide $TiO_2$, clays and other pigments or charges used in the paper industry and generally known to the skilled man. Depending on the granulometry of the two PCCs the third, coarser component, may be omitted.

TECHNICAL PROBLEM

There is a definite need, in the paper-making industry, for a pigment composition comprising namely calcium carbonate(s), in specific combination, and possibly in combination with other pigments or fillers, in order to improve intricate, or finely tuned and delicate technical properties of the final paper sheet, such as "print show through" or "print strike through" in paper applications like Newsprint, light weight fine papers or wood free light papers, supercalendered magazines and so on.

Those properties are well known to the skilled man, and details will be found in attached ANNEX A in the domain of Newsprint.

In particular, it would be highly interesting to provide to the industry such a formulation which would improve those properties and if possible at a lower cost.

SUMMARY OF THE PREFERRED MODE OF THE INVENTION

In a first embodiment, the invention consists of a composition comprising a blend or mix of one of the two porous, stable aggregates and rather coarse (2-10 μm) PCCs called Grade B or Grade C PCC, in combination with a second, specific S-PCC (S-PCC=scalenohedral type PCC) pigment as described here-below.

It might also be possible to use R- or A-PCC as well as third component.

According to the invention, the said ratio can be appropriately selected between 90/10 and 10/90 parts per hundred (percent) by dry weight, namely 80/20 and 20/80.

Best representative examples are, as exemplified here-below:

PCC Grade C/S-PCC (Ratio=50/50);
PCC Grade B/S-PCC (Ratio=70/30); and
PCC Grade B/S-PCC (Ratio=50/50)
(with ratio in percent by dry weight).

In the present application and claims, "comprising" means, except otherwise stated, that the composition, formulation, mixture or blend may contain usual additives having no noticeable effect on the function of the essential component used in the present invention.

Each inventive formulation may comprise the usual additives known and used in this paper-making industry, without noticeably affecting the results.

The list of such routine additives is well known to the skilled man.

In the most preferred mode, the invention consists of a composition comprising either a PCC Grade A or a PCC Grade B, in combination with the second pigment S-PCC, as mentioned above, in a ratio 90/10 to 10/90 by dry weight, and in combination with a third, coarser, specific pigment.

The percentage by dry weight of the total of the inventive blends of pigments is preferably chosen between 0.3 to 5%, most preferably between 0.5% to 3% by dry weight of the final paper product, and still more preferably between 1.0% to 2.0%. In the laboratory testings, the percentages have been selected at 2 and respectively 4% for practical reasons.

As to the proportion of the coarser pigment vs. the total of the three PCC Grade B or Grade C+S-PCC+coarser pigment, it must remain below 10 w % (w %=% by weight), and preferred ranges are from 0.1 to 10 w %, preferably from 0.5 to 7-10 w %, and most preferably between 2 to 7 w %.

The skilled man will be able to adapt those examples to other formulations.

In the following, and in particular in the Tables, the two or three components blend according to the invention will be named as "primary" since the examples have been performed with recycled paper based newsprint furnish and that they are the fresh used fillers.

The rest of the pigments, such as calcium carbonate of any kind, clay etc. . . . resulting from the recycled paper based newsprint furnish, will be named "secondary".

The invention will be better understood in the following non-limiting examples, which are summarized in the accompanying Tables.

Figure 1:
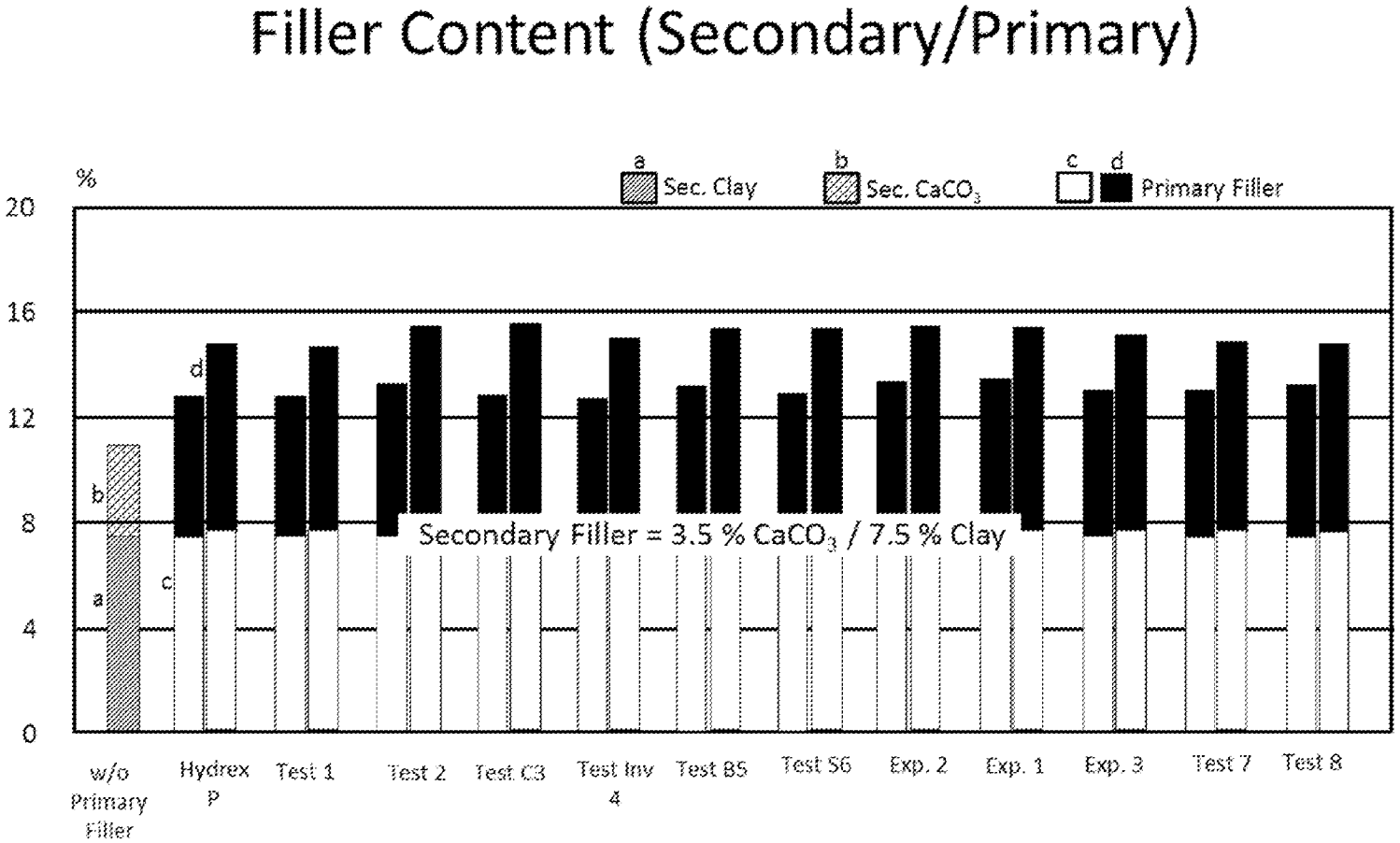
FIG. 1: Figure showing filler content (secondary/primary). The secondary (that is, classical) pigment/filler blend is a mixture of 3.5% $CaCO_3$ and of 7.5% of clay, by weight, forming an S-level of 11% regarded as the minimum acceptable. In comparison, in addition to this 11 w % of classical fillers has been added 2 w % of the total blend (left-hand column) or respectively 4 w % (right-hand column) of the filler(s) indicated at the bottom of the Table, corresponding to the tests and experiments of Table 1. The percentage relates to the total percentage of the pigments in the total of fibre pulp+filler(s), by weight.

As will be explained here-below, the main criteria for selecting the said "coarser" pigment is that it should feature a granulometry which does not affect noticeably, when in admixture with the blend PCC Grade B (or PCC Grade C) with S-PCC (all being exemplified below and in the Table 1), the finest part of the granulometry data of the blend, and in particular that it should not contribute anything significant to the amount of particles <0.2 μm, preferably nothing <0.3 μm, more preferably nothing <0.5 μm and most preferably nothing <1 μm.

Any filler or pigment matching the above criteria are acceptable and can be routinely tested by the skilled man among those used in the paper industry or a similar industry, such as PCC, GCC (ground calcium carbonate, natural), clays, kaolin, dolomite, Titanium oxyde ($TiO_2$) etc. . . .

Table 1 Shows the "Pigment Data" which are Referred to in the Experiments:

In the left-hand column, all the measures and properties are standard ones, well known to the skilled man, such as BET specific surface area measured according to the ISO standard 9277 or particle size distribution established in a Sedigraph™ 5100 equipment manufactured by Micromeritics™.

Viscosity B means Brookfield Viscosity, measured with a Brookfield viscometer at 25° C. and the appropriate spindle and speed.

The surface charge is measured according to a known method and is not particularly useful for the understanding of the present invention. However, the skilled man will appreciate that it could be very useful when considering water-based inks involving charged dyes, unless you do not wish to implicate water-based inkjet by default, though flexography (frequently used for newsprint today, can also apply such inks.

Brightness R-457 is known to the skilled man as well, and the said Brightness R-457 is measured according to the DIN standard 53140 using an equipment DATACOLOR ELREPHO™ 3300.

The dispersing agent is selected among the usual agents known and used in this paper-making industry, such as a polycarboxylate and so on. It is not particularly useful for the understanding of the present invention. However, if the polymer provides a certain surface charge that promotes adsorption of certain ink dyes, then it could be highly relevant for the understanding: again, the comments above apply.

Oil-absorption is measured according to a known method and is not particularly useful for the understanding of the present invention.

HYDREX™ P is a commercial product which is a Na silicate and which represents a well-known standard. When analysing the Tables, and namely Table 1, "Pigment Data", it is surprising to notice that the inventive compositions feature a far lower BET value than the HYDREX P, with better or similar properties as can be seen in the Tables.

Test 1 relates to a $H_3PO_4$-treated chalk, with a solid content of 38% by weight.

Test 2 relates to a marble treated with $H_3PO_4$, also with a solids content of 38% by weight.

Test "C 3" relates to the "PCC Grade C" product.

Test "INV 4" is a preferred composition of the invention, which is a blend of PCC Grade C/S-PCC 50/50 (percentage by dry weight).

Test "B 5" relates to the "PCC Grade B" product.

Test "S 6" relates to the "S-PCC" (S for "scalenohedral").

Experiments (Exp) 1 and 2 are experiments conducted according to this invention:

Exp. 1 corresponds to a 50/50% dry weight blend of the invention, of PCC Grade B/S-PCC.

Exp. 2 corresponds to a 70/30% dry weight blend of the invention, of PCC Grade C/S-PCC.

Exp. 3 corresponds to a comparative product, that is a blend 50/50% by weight of PCC grade B and chalk.

Test 7 is a comparative experiment conducted with a natural (ground) calcium carbonate which is 100% chalk.

Test 8 is another comparative experiment conducted with a ground calcium carbonate.

Table 2 Tests Conditions

The conditions of the laboratory paper production tests are summarized in Table 2. DIP means de-inked pulp, as is known.

The retention aid(s) can be different from the used Polymin™ and can non-limitatively be either mono-component or so-called "dual" systems, such as inter alia acrylic (co)polymers (acrylamides) and a secondary retention aid like bentonite, or starches or starch derivatives, etc. . . . as is well known to the skilled man.

FIG. 1 shows Filler Content (Secondary/Primary).

The secondary (that is, classical) pigment/filler blend is a mixture of 3.5% $CaCO_3$ and of 7.5% of clay, by weight, forming an S-level of 11% regarded as the minimum acceptable.

In comparison, in addition to this 11 w % of classical fillers has been added 2 w % of the total blend (left-hand column) or respectively 4 w % (right-hand column) of the filler(s) indicated at the bottom of the Table, corresponding to the tests and experiments of Table 1.

The percentage in FIG. 1 relates to the total percentage of the pigments in the total of fibre pulp+filler(s), by weight.

As to the process for introducing the fillers into the fibre pulp or stock, the order of addition is not crucial; it is however preferred to introduce the inventive "primary" blend of two or three pigments in a pulp that already contains at least the minimum S-level of 11% or more. To be noted for completeness, impact of the primary filler is not related to the amount of secondary filler, it works also with 100% fresh pulp not carrying secondary pigment.

It is possible to add the inventive blend of pigments in one operation or injection, or in several injections at different points of the line. It is also possible to prepare premixes of the various fillers, including premixes of a part of the classical ("secondary") fillers with a part or the total amount of the inventive ("primary") fillers. Several such premixes may be introduced at different points along the line. Premixing the primary filler with secondary filler in the DIP is not really practical as the secondary pigment is within the DIP fiber furnish, but can be used.

It is well known in this industry that the skilled man can adapt those injection point(s) namely in view of the existing equipment, the desired degree of shear, contact time etc. . . .

Figure 2:
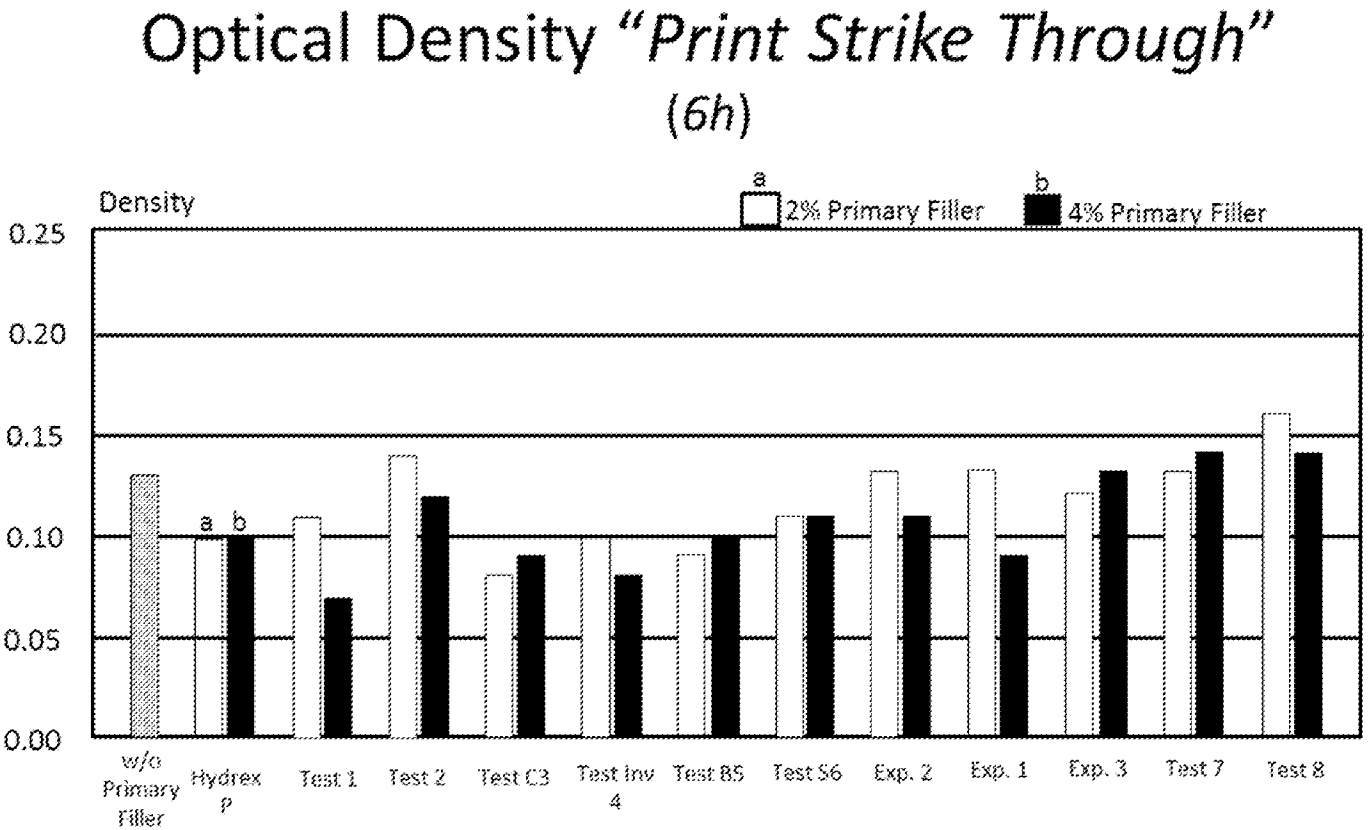
FIG 2: Figure showing optical density for "print strike through." Results obtained with the formulations in the described paper-making test.

FIG. 2 shows Optical Density "Print Strike Through."

This table shows the results obtained with the above formulations, in the described paper-making test.

"Print Strike Through" is a property whose measurement is detailed in ANNEX A and in EP 1 712 597.

Figure 3:
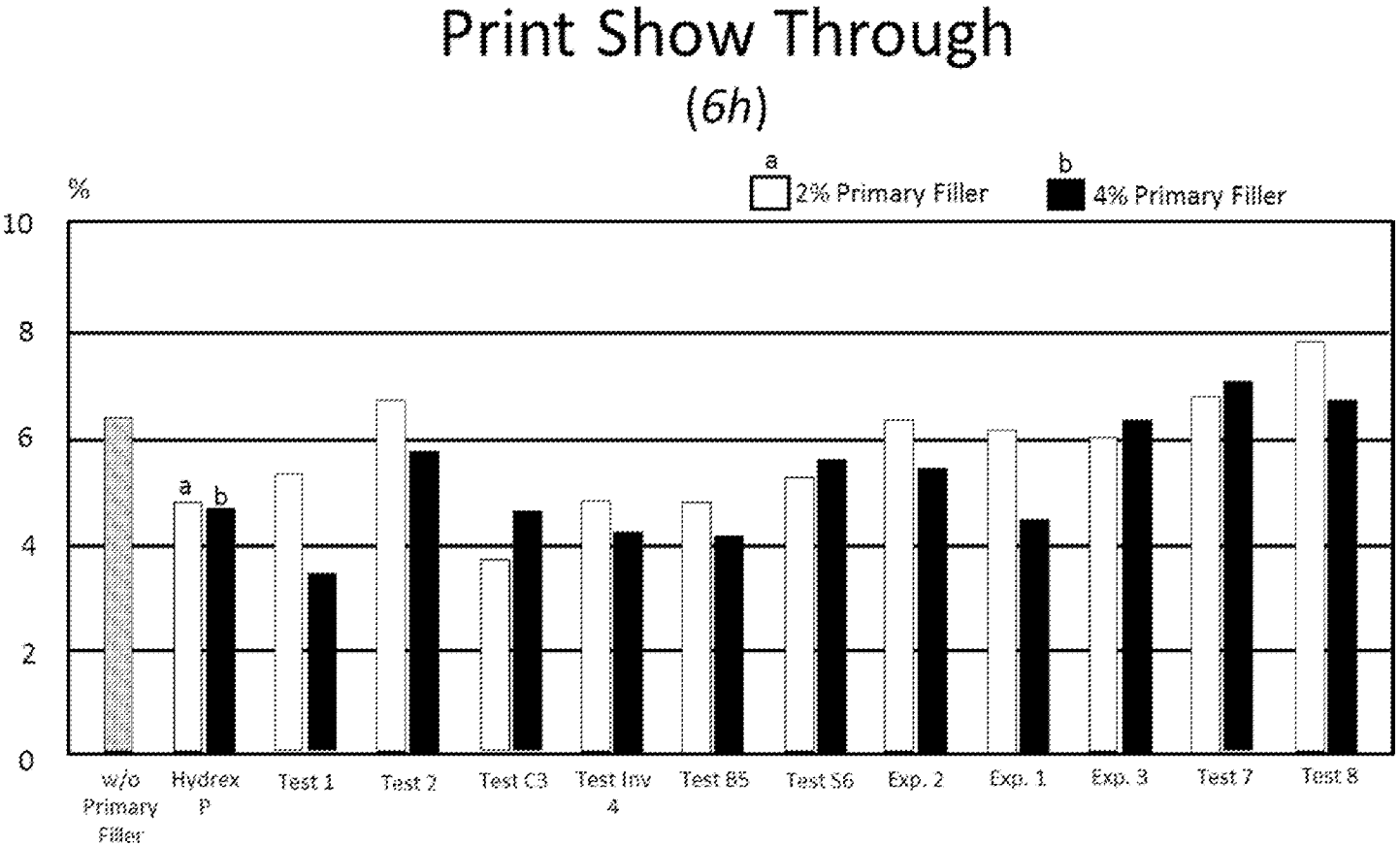
FIG. 3: Figure showing "print show through" measurements. Results obtained with the formulations in the described paper-making test.

FIG. 3 shows "Print Show Through."

This table shows the results obtained with the above formulations, in the described paper-making test.

"Print Show Through" is a known property whose measurement is made according to the method of ANNEX A.

The present invention also encompasses the fibres-containing pulps or stock for the fabrication of a sheet of paper, namely in a paper-making plant, characterized in that it contains an effective amount of the compositions of pigment blends of the invention, as described above, in an effective amount, namely that also described above.

The invention also encompasses the paper product produced from the above pulp or stock. as mentioned it works also with 100% mechanical fiber, blends of mech. fiber and DIP/DIP, most likely also with 100% fresh chemical pulp.

PRINT THROUGH IN NEWSPRINT ANNEX A

The cause of print through in newsprint is linked to opacity, porosity, ash content, roughness and surface weight of the paper.

Since newspaper printing inks dry through an entirely physical process, and not through oxidation as with curved offset printing, or evaporation of volatile substances as with roll offset/heat offset printing, migration of mobile substances such as mineral and plant oils into the paper occurs, and these are absorbed by the paper fibres and fillers. If the proportion of migrating oils becomes too great (too high a proportion of printing ink content), and the inner surface layer of the paper too thin, then a part of the oils will reach the other side of the paper and cause an increase in transparency.(1)

With this test method, production control of paper manufacture can be carried out. It is possible to obtain a good indication of variations in production, since the amount of ink and print pressure are so high, that a clear print through of the print must become visible, and thus weak or strong print through is also recognisable.

This method can not be used as a standard test in our test laboratory, because we are not looking to control production quality, but to compare various surface weight papers from different manufacturers with each other in the most objective way possible. In addition, we have to work with the most commonly practised ink amounts and printing pressures.(2)

Since we are looking to obtain an indication that is truest to common practice for the various newspapers, this method sets the amount of ink, in conformity with common practice printing pressure, to the required optical density.

In this way, any print through is a result of the paper used, and not of the amount of ink.

If too high a ink amount and too high a printing pressure are used, lower surface weight papers are automatically put at a disadvantage.

Conditions: Ink: Rollo-Temp Black "Hit" 29C0262.000 newspaper print ink, from Stehlin & Hostag, Lachen
Spring-load tension: 70 kgf (35 kp/cm$^2$)
3 test strips using laboratory sheet paper on the printed side
3 test strips using common practice newspaper, per side
Sampling: after determining the individual weights of each sample paper (especially the laboratory sheets), this test only used those papers that came nearest to each other in surface weight. This was applicable for the whole range of papers to be tested.

Running of the Test: deposit 1.0 cm$^3$ of ink
rub in the ink for 8 minutes
ink up the pressure disks for 1 minute
make two prints (one topside, one underside)
add a further 0.060 cm$^3$ of ink
rub for 4 minutes
ink up the pressure disks for 1 minute
continue for 12 prints and then ink up again
Print through which appears on the opposite side of the printed strip is only measured by densitometry after at least 6 hours.
measurements are made after 18 cm of printed surface, across the width of the strip. The mean average of 3 individual spot measurements is determined.

Results: mean average of three measurements taken from the topside and underside of the strip (except for laboratory test sheets, which are only measured on one side), the results are given as optical density values, including an indication of which side (topside "O" or underside "U") the measurement was taken from Special Remarks: the test apparatus (printing drums) must be thoroughly cleaned with petroleum spirit after each print. The tension spring must be released.

Determination of 100/Density print×Density print through=Print show through Transparency:

Evaluation: <5: good
>5: critical

If too high an ink amount and too high a printing pressure are used, lower surface weight papers are automatically put at a disadvantage.

Notes:

(1) However, this document doesn't take into account the large proportion of newsprint printed today using flexography, which can be water-based and can also adopt oxidative processes (2) Such a test in the laboratory is not intended to be an absolute standard, but is designed to compare performance with known acceptably and unacceptably performing papers. As such, the amount of ink and printing pressures are adjusted according to the paper weights and application criteria, but maintained as closely as possible to those used in practice

TABLE 1

Pigment Data

| | Hydrex P | Test 1 | Test 2 | Test C3 | Test Inv 4 | Test B5 | Test S6 | Exp. 2 | Exp. 1 | Exp. 3 | Test 7 | Test 8 |
|---|---|---|---|---|---|---|---|---|---|---|---|---|
| Spec. Surface BET (m$^2$/g) | 90.5 | 33.9 | 60.5 | 75.9 | 42.9 | 70.5 | 8.8 | 56.7 | 42.0 | 41.9 | 3.7 | 4.7 |
| Sedigraph 5100 | | | | | | | | | | | | |
| <5 μm (%) | 97 | 87 | 97 | 99 | 99 | 98 | 98 | 99 | 99 | 91 | 78 | 86 |
| <2 μm (%) | 79 | 62 | 68 | 66 | 72 | 66 | 64 | 69 | 70 | 63 | 43 | 63 |
| <1 μm (%) | 61 | 36 | 34 | 35 | 27 | 32 | 28 | 36 | 37 | 34 | 14 | 26 |
| <0.5 μm (%) | 42 | 24 | 20 | 16 | 8 | 12 | 12 | 16 | 18 | 17 | 1 | 8 |
| <0.2 μm (%) | 23 | 17 | 13 | 11 | 3 | 6 | 5 | 7 | 8 | 8 | — | 3 |
| APS (μm) | 0.68 | 1.47 | 1.49 | 1.44 | 1.48 | 1.48 | 1.63 | 1.37 | 1.39 | 1.5 | 2.34 | 1.62 |
| Brightness R-457 (%) | 96.8 | 85.9 | 93.2 | 94.8 | 94.6 | 95.2 | 96.4 | 95.1 | 95.9 | 88 | 83.7 | 83.4 |
| Viscosity B. (mPas) | 100 | 100 | 70 | 370 | 300 | 210 | 383 | 526 | 434 | 488 | 50 | 190 |
| Solids content (%) | 30 | 39 | 28 | 38 | 37 | 29 | 48 | 31 | 34 | 38 | 66 | 73 |
| Dispersing agent (%) | 2.51 | 0.93 | 1.21 | 3.00 | 1.63 | 0.20 | 0.28 | 0.22 | 0.22 | 0.23 | 0.20 | 0.22 |
| Surface charge (Val/g) | −250.7 | −93.5 | −120.7 | −284.7 | −163.1 | −20 | −28.2 | −22 | −22 | −22.6 | −20.3 | −21.6 |
| pH | 7.6 | 8.1 | 9.9 | 8.1 | 8.6 | 8.8 | 8.7 | 8.6 | 8.7 | 8.4 | 8.3 | 8.1 |
| Oil-absorption (g/100 g) | 65 | 47 | 60 | 73 | 67 | 48 | 47 | 47 | 42 | 37 | 17 | 19 |

TABLE 2

Conditions

Fibers
100 DIP
Primary Filler Additions
2% and 4% on top of 11% secondary pigment
Retention
0.04% Polymin 1530 (%/dry pulp)
Wetpress (0.42 MPa)
Dixon Calender
22.5 bar - to reach 4.0 μm PPS
1 × WS on steel

What is claimed is:

1. A composition comprising a blend or mixture of (i) a Grade B precipitated calcium carbonate (PCC) and/or a Grade C PCC and (ii) a scalenohedral PCC (S-PCC), wherein the Grade B PCC has the following particle size distribution: 98% of particles are <5 microns, 66% of particles are <2 microns, 32% of particles are <1 microns, 12% of particles are <0.5 microns and 6% of particles are <0.2 microns, and wherein the Grade C PCC has the following particle size distribution: 99% of particles are <5 microns, 66% of particles are <2 microns, 35% of particles are <1 microns, 16% of particles are <0.5 microns and 11% of particles are <0.2 microns.

2. The composition according to claim 1, wherein ratio of (i) and (ii) is between 90/10 and 10/90 percent by dry weight.

3. The composition according to claim 1, wherein the ratio of (i) and (ii) is between 80/20 and 20/80.

4. The composition according to claim 1, that comprises Grade C PCC and S-PCC at a ratio of 50/50 by dry weight.

5. The composition according to claim 1, that comprises Grade B PCC and S-PCC at a ratio of 70/50 by dry weight.

6. The composition according to claim 1, that comprises Grade B PCC and S-PCC at a ratio of 50/50 by dry weight.

7. The composition according to claim 1, further comprises an additional mineral filler or pigment.

8. The composition according to claim 7, wherein the additional mineral filler or pigment is natural calcium (ground) carbonate, PCC, talc, kaolin, titanium oxide ($TiO_2$), clay, or dolomite.

9. The composition according to claim 7, wherein the additional mineral filler or pigment is PCC.

10. The composition according to claim 7, wherein the additional mineral filler or pigment is present at less than 10 wt % of the total weight of (i) Grade B PCC and/or Grade C PCC, (ii) S-PCC, and (iii) additional mineral filler or pigment.

11. The composition according to claim 7, wherein the additional mineral filler or pigment is present at 0.1 to 10 wt % of the total weight of (i) Grade B PCC and/or Grade C PCC, (ii) S-PCC, and (iii) additional mineral filler or pigment.

12. The composition according to claim 7, wherein the additional mineral filler or pigment is present at 0.5 to 7 wt % of the total weight of (i) Grade B PCC and/or Grade C PCC, (ii) S-PCC, and (iii) additional mineral filler or pigment.

13. The composition according to claim 7, wherein the additional mineral filler or pigment is present at 2 to 7 wt % of the total weight of (i) Grade B PCC and/or Grade C PCC, (ii) S-PCC, and (iii) additional mineral filler or pigment.

14. The composition according to claim 7, wherein the additional mineral filler or pigment has a granulometry which does not affect noticeably, when in admixture with (i) Grade B PCC and/or Grade C PCC and (ii) scalenohedral PCC (S-PCC), the amount of particles <0.2 μm.

15. The composition according to claim 7, wherein the additional mineral filler or pigment has a granulometry which does not affect, when in admixture with (i) Grade B PCC and/or Grade C PCC and (ii) scalenohedral PCC (S-PCC), the amount of particles <0.3 μm.

16. The composition according to claim 7, wherein the additional mineral filler or pigment has a granulometry which does not affect, when in admixture with (i) Grade B PCC and/or Grade C PCC and (ii) scalenohedral PCC (S-PCC), the amount of particles <0.5 μm.

17. The composition according to claim 7, wherein the additional mineral filler or pigment has a granulometry which does not affect, when in admixture with (i) Grade B PCC and/or Grade C PCC and (ii) scalenohedral PCC (S-PCC), the amount of particles <1 μm.

18. A fiber-containing pulp comprising the composition according to claim 1.

19. A paper product comprising the fiber-containing pulp according to claim 18.

20. The paper product according to claim 19, which comprises between 0.3 to 5% by dry weight of (i) Grade B PCC and/or Grade C PCC, (ii) scalenohedral PCC (S-PCC), and optionally (iii) an additional mineral filler or pigment that is courser than (i) Grade B PCC and/or Grade C PCC, and (ii) S-PCC.

21. The paper product according to claim 19, which comprises between 0.5 to 3% by dry weight of (i) Grade B PCC and/or Grade C PCC, (ii) scalenohedral PCC (S-PCC), and optionally (iii) an additional mineral filler or pigment that is courser than (i) Grade B PCC and/or Grade C PCC, and (ii) S-PCC.

22. The paper product according to claim 19, which comprises between 1 to 2% by dry weight of (i) Grade B PCC and/or Grade C PCC, (ii) scalenohedral PCC (S-PCC), and optionally (iii) an additional mineral filler or pigment that is courser than (i) Grade B PCC and/or Grade C PCC, and (ii) S-PCC.

* * * * *